US009671204B2

(12) United States Patent
Rhee et al.

(10) Patent No.: US 9,671,204 B2
(45) Date of Patent: Jun. 6, 2017

(54) RIFLE GRENADE USING BULLET TRAP

(71) Applicant: Hanwha Techwin Co., Ltd., Changwon-si, Gyeongsangnam-do (KR)

(72) Inventors: Joon Seong Rhee, Daejeon (KR); Min Su Park, Daejeon (KR); Soon Suk Park, Daejeon (KR); Jun Goo Shin, Daejeon (KR)

(73) Assignee: Hanwha Techwin Co., Ltd., Changwon-si (KR)

( * ) Notice: Subject to any disclaimer, the term of this patent is extended or adjusted under 35 U.S.C. 154(b) by 578 days.

(21) Appl. No.: 14/105,863

(22) Filed: Dec. 13, 2013

(65) Prior Publication Data

US 2016/0223308 A1 Aug. 4, 2016

(30) Foreign Application Priority Data

Aug. 23, 2013 (KR) ..... 10-2013-0100489

(51) Int. Cl.

| | |
|---|---|
| ***F42B 10/00*** | (2006.01) |
| ***F42B 30/06*** | (2006.01) |
| ***F42B 12/58*** | (2006.01) |
| ***F42B 12/62*** | (2006.01) |
| *F42B 10/06* | (2006.01) |
| *F41H 7/00* | (2006.01) |

(52) U.S. Cl.

CPC ..... *F42B 30/06* (2013.01); *F42B 12/58* (2013.01); *F42B 12/625* (2013.01); *F41H 7/005* (2013.01); *F42B 10/06* (2013.01)

(58) Field of Classification Search

CPC ..... F42B 30/04; F42B 30/06
USPC ..... 102/483–485
See application file for complete search history.

(56) References Cited

U.S. PATENT DOCUMENTS

| | | | | |
|---|---|---|---|---|
| 3,882,780 A * | 5/1975 | Gawlick | F42C 14/02 | 102/483 |
| 3,934,513 A * | 1/1976 | Gabriels | F42B 30/06 | 102/485 |
| 4,013,011 A * | 3/1977 | Gabriels | F42B 30/06 | 102/485 |
| 4,567,831 A * | 2/1986 | Gordon | F42B 30/06 | 102/485 |

(Continued)

FOREIGN PATENT DOCUMENTS

| | | |
|---|---|---|
| JP | 2008-051472 A | 3/2008 |
| KR | 10-1984-0002520 A | 7/1984 |
| KR | 10-2002-0078569 A | 10/2002 |

OTHER PUBLICATIONS

Auvsi 2011 Photo Report—First Impressions, Drones & Robotics, Aug. 18, 2011, 6 pages.

(Continued)

*Primary Examiner* — Samir Abdosh
(74) *Attorney, Agent, or Firm* — Sughrue Mion, PLLC

(57) ABSTRACT

Disclosed is a rifle grenade using a bullet trap. A propellent assembly is formed with a first housing configured to house a trapping unit that traps a bullet shot from a gun to travel from rear to front and absorbs kinetic energy of the bullet, and a second housing configured to house a propelling unit that is disposed in front of the first housing, and is activated by the kinetic energy of the bullet which is absorbed into the trapping unit to provide a propelling force in a trajectory direction of the rifle grenade.

23 Claims, 7 Drawing Sheets

(56) References Cited

U.S. PATENT DOCUMENTS

| | | | | | |
|---|---|---|---|---|---|
| 4,747,349 | A * | 5/1988 | Schilling | F42B 30/06 | 102/485 |
| 4,846,070 | A * | 7/1989 | Gabriels | F42B 10/12 | 102/482 |
| 5,153,374 | A * | 10/1992 | Gabriels | F42B 30/06 | 102/484 |
| 5,349,906 | A * | 9/1994 | Devaux | F42B 30/06 | 102/485 |
| 6,408,765 | B1 * | 6/2002 | Tauber | F42B 30/06 | 102/275.3 |
| 6,523,478 | B1 * | 2/2003 | Gonzalez | F42B 30/04 | 102/216 |
| 6,688,032 | B1 * | 2/2004 | Gonzalez | F42B 12/50 | 102/485 |

OTHER PUBLICATIONS

B. S. Kang et al., "Protector Design and Shock Analysis for a Launch-Reconnaissance Robot", Transactions of KSME (A), 2011, vol. 35, No. 8, pp. 971-976. English Language Abstract on p. 971.

S. H. Lee et al., "The Development of Small-Sized Launchable Robot for Reconnaissance", Journal of KIMST, 2012, vol. 15, No. 5, pp. 535-542. English Language Abstract on p. 535.

* cited by examiner

RIFLE GRENADE USING BULLET TRAP

CROSS REFERENCE TO RELATED APPLICATION(S)

This application claims the benefit of Korean Patent Application No. 10-2013-0100489, filed on Aug. 23, 2013, which is hereby incorporated by reference in its entirety into this application.

BACKGROUND OF THE INVENTION

1. Technical Field

The present invention relates generally to a rifle grenade using a bullet trap and, more particularly, to a rifle grenade using a bullet trap, which is loaded on a gun such as a rifle, allows a robot mounted in a protective shell to be discharged toward a target by kinetic energy of a fired bullet, and generates a propelling force from the kinetic energy of the bullet so as to be able to be aimed and fired at a more distant target.

2. Description of the Related Art

A rifle grenade is loaded on a muzzle of a rifle that is an individual weapon for the purpose of causing casualties or destroying major facilities when small units fight in combat at a short range, and is directly or indirectly fired from the rifle. The rifle grenade is a sort of bomblet, in a protective shell of which an explosive or chemical shaped charge is filled, and is a firepower support weapon which is operated to supplement fighting power of the small unit within a range between a maximum throwing distance of a hand grenade and a minimum shooting range of a mortar that is a crew-served weapon.

The structure of a shell of the rifle grenade is made up of a stabilizer tube that is inserted and fixed around a muzzle, fins that cause the rifle grenade to fly toward a fixed target based on detonation of a propelling charge contained in a separate charge cartridge, a fuse that is activated at a point of impact by an impact, a shaped charge that is detonated by ignition of the fuse, and a metal warhead that is fragmented by detonation of the shaped charge and is scattered into hundreds of fragments.

Unlike the hand grenade that is thrown by hand and is detonated within a limited range of a fixed distance, the rifle grenade having the structure as described above is loaded on the muzzle of the rifle that is the individual weapon, and is fired from the rifle. Thus, the rifle grenade has an increased shooting range, i.e. an effective shooting range, compared to the throwing distance of the hand grenade. The rifle grenade is a weapon in which a metal outer shell thereof is fragmented into hundreds of small fragments and scattered by detonation of the shaped charge filled therein, thereby incapacitating a target in a fixed radius.

Such a rifle grenade is mainly used for an antipersonnel weapon, destruction of an armored vehicle, destruction of a bunker and a stronghold covered up with soil, an attack of targets in a building, an attack of targets in dense woods, an attack of targets in a dead zone, supplementation of a crew-served weapon that is a firepower support weapon, a firepower support for assault combat, formation of a smokescreen for signaling and hiding, and night lighting.

In the conventional rifle grenade as described above, when the rifle grenade is intended to be fired during rifle shooting, a grenade launcher is mounted on the muzzle of the rifle, and a ball cartridge is removed from a cartridge chamber. Then, the ball cartridge is replaced with a separate charge cartridge. After the rifle grenade is fired, the charge cartridge is replaced with the ball cartridge again. This replacement is inconvenient, and requires an unnecessary additional time, so that it is impossible to immediately fire back enemy personnel, and thus to maintain fighting agility. In addition, there are risks in which, when a rifleman fires the rifle grenade without removing the ball cartridge by mistake, the rifle grenade is detonated in front of the muzzle. For this reason, there is a risk of surrounding personnel being injured.

Although not shown in the drawing, to supplement such problems, a device in which a separate grenade launcher is provided under the barrel of the rifle. In this way, a weapon having both a function of the rifle and a function of the grenade launcher is developed and operated. However, such a weapon has problems in that, due to an additional percussion lock, an additional manufacturing cost is required, and weight thereof is increased to impose restrictions on carrying and handling. In particular, since the weapon is given only to some limited specific members, firepower support is also limited.

On the other hand, the rifle that is a basic weapon which the rifleman carries is burdensome to the rifleman due to its weight. Such a burden makes it inconvenient to carry and handle the rifle. Thus, to solve this problem, the rifle is developed to reduce weight in order to improve the effectiveness in fighting scenarios.

In this case, it is preferable that the rifle that is the basic weapon which each member of the small unit carries is improved in structure and reduced in weight so as to be able to shoot the grenade. However, since a structural change of the rifle requires an enormous cost, a structural change is not economical. In addition, even when the rifle is improved by such a structural change, the conventional problems cannot be completely removed.

In contrast, instead of improving the structure of the rifle, the structure of the rifle grenade may be improved, which is considered to be an efficient countermeasure. This is why, when the rifle grenade of the present invention is loaded on the rifle that is the individual basic weapon regardless of specific rifles, and is shot with the ball cartridge, a separate launcher is not required.

DOCUMENTS OF RELATED ART

Korean Patent Application Publication No. 1984-0002520 (RIFLE GRENADE, published on Jul. 2, 1984)

SUMMARY OF THE INVENTION

An aspect of the present invention is to provide a rifle grenade using a bullet trap, which is loaded on an individual weapon, and further increases a range of impact and a resultant effective range.

Another aspect of the present invention is to provide a rifle grenade using a bullet trap, which absorbs an impact transmitted to a holder capable of mounting a robot or an explosive in a protective shell in all directions, thereby effectively preventing an object mounted in the holder from be damaged.

Still another aspect of the present invention is to provide a rifle grenade using a bullet trap, in which the robot mounted in the holder can be controlled using an external controller by wireless, transmit video data around a point of impact when the protective shell reaches the point of impact, and detonate an embedded explosive cartridge to quickly strike enemy personnel when detecting the enemy personnel or when reaching an enemy line.

In order to solve the above-mentioned problems, the present invention provides a rifle grenade using a bullet trap including: a propellent assembly that has a first housing configured to house a trapping means that traps a bullet shot from a gun to travel from rear to the front and absorbs kinetic energy of the bullet, and a second housing configured to house a propelling means that is disposed in front of the first housing, is activated by the kinetic energy of the bullet which is absorbed into the trapping means, and provides a propelling force in a trajectory direction of the rifle grenade; and a stabilizer assembly in which a hollow through which the bullet goes is formed, which is coupled to the propelling means in the front of the hollow so as to face the first housing, and which is coupled to the gun in the rear of the hollow so that the bullet reaches the propelling means through the hollow.

The present invention provides the rifle grenade using the bullet further including a protective shell that is coupled to the front of the propellent assembly, and includes a holder which is movably installed in a third housing formed therein, and a damping means which is disposed between the third housing and the holder to reduce an external impact transmitted to the holder.

It is characterized that the holder may be mounted with a robot.

The damping means includes a first damper supported at the front of the third housing; and a second damper supported in the rear of the third housing.

The first damper and the second damper includes a cylinder which has a flange whose one end is supported on the third housing and whose other end is supported on the holder, and is extendable between one end and the other end thereof; and an elastic member which is provided on an outer surface of the cylinder, and is installed so as to be supported at the third housing and the flange.

The damping means may further include a damping pad which is provided on an inner circumferential surface of the third housing and reduces an impact transmitted to an outer circumferential surface of the holder.

The propellent assembly further includes a plurality of nozzle holes which are formed so as to extend from the outer circumferential surface of the propellent assembly into the second housing.

The propellent assembly further includes a hammer hole which is formed so as to extend from the second housing to the first housing.

The propelling means includes a propellant housed in the second housing; an igniter connected to the propellent; and a propellent detonator which is connected to the igniter and installed so as to be inserted into the hammer hole.

The propelling means further includes a retardant which is provided between the propellent detonator and the igniter to retard an ignition time of the igniter for a predetermined time when the propellent detonator is activated.

The propellent assembly further includes a sealing cover which is provided in the second housing so as to seal the propelling means.

The trapping means includes a trap part which is provided at a rear inner side of the first housing facing the hollow and traps the bullet shot so as to go through the hollow; and a percussion part which is provided at a front inner side of the first housing and activates the propelling means using the kinetic energy of the bullet trapped by the trap part.

The percussion part includes a percussion pin which is provide so as to come into close contact with one surface of the trap part which is the opposite surface of the other surface of the trap part which faces the stabilizer assembly, and is installed in the first housing so as to be slidable in a direction of the second housing; and a safety spring which is provided at the front inner side of the first housing facing the second housing and is installed so as to elastically support the percussion pin in a rearward direction.

It is characterized that the kinetic energy of the bullet trapped by the trap part is high enough for the percussion pin to pressurize the safety spring to activate the propelling means.

It is characterized that the propellent assembly further includes a safety pin installed so as to pass through the percussion pin from a side of the propellent assembly.

The stabilizer assembly may further include a safety cover which is provided in the front of the hollow to cover the front of the hollow.

The stabilizer assembly further includes a plurality of fins formed on an outer circumferential surface of the stabilizer assembly.

It is characterized that the robot includes a wireless communication unit configured to transmit and receive a control signal and data to and from an external controller, and is remotely controlled.

It is characterized that the robot includes a photographing unit which is installed on the robot to transmit video data obtained by photographing an environment around a place where the robot is located to the controller using the wireless communication unit.

The robot includes an explosive cartridge which is installed on the robot to be exploded by the control signal of the controller.

The explosive cartridge may include a fragmentation or thermobaric warhead to which a high explosive for causing casualties is applied.

The explosive cartridge may include a warhead to which a tear gas or a sleeping gas that is a non-lethal weapon is applied.

It is characterized that, when enemy personnel are detected by a sensing means embedded in the robot, the robot is set so as to allow the explosive cartridge to be automatically exploded using the controller.

The holder may further include a repeater configured to increase a wireless communication distance between the controller and the robot.

According to the rifle grenade of the present invention, the following effects are provided.

The rifle grenade using the bullet trap of the present invention is mounted on an individual weapon to further increase a range of impact, so that an effective shooting range can be enhanced.

The rifle grenade using the bullet trap of the present invention absorbs the impact transmitted to a holder capable of mounting the robot or the explosive in the protective shell in all directions, so that an object mounted in the holder can be effectively prevented from be damaged.

The rifle grenade using the bullet trap of the present invention in which the robot mounted in the holder can be controlled using the external controller by wireless and transmit surrounding video data of the point of impact when the protective shell reaches the point of impact, or explode the embedded explosive cartridge to injure enemy personnel when the robot encounters the enemy personnel or reaches the enemy line.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
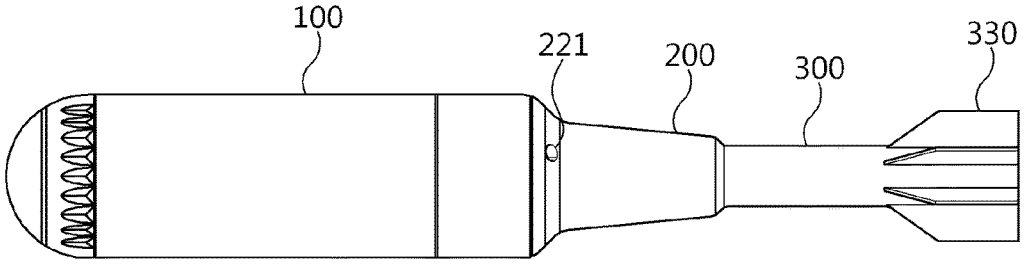
FIG. 1 is a diagram schematically illustrating a rifle grenade using a bullet trap according to the present invention.

The present invention will be described below in detail with reference to the appended drawings.

Here, the repeated description and the detailed description of the known function and configuration that would make a description of the gist of the present invention unnecessarily obscure will be omitted.

Embodiments of the present invention are provided to more completely describe the present invention to a person with ordinary skill in the art.

Shapes and sizes of components in the drawings may be modified for clearer description.

Figure 2:
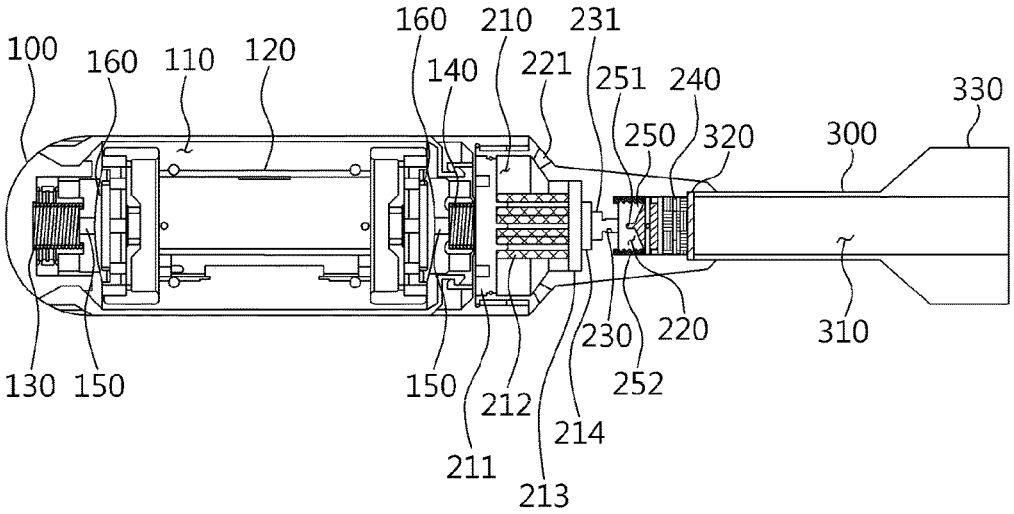
FIG. 2 is a diagram schematically illustrating a cross section of the rifle grenade using the bullet trap according to the present invention.

FIG. 1 is a diagram schematically illustrating a rifle grenade using a bullet trap according to the present invention, and FIG. 2 is a diagram schematically illustrating a cross section of the rifle grenade using the bullet trap according to the present invention.

According to the present invention, a long-range rifle grenade which uses a trap of a bullet B and has a warhead mounted with a robot 400 includes a propellent assembly 200 that is provided with a first housing 220 configured to house a trapping means that traps the bullet B shot from a gun to travel from rear to front and absorbs kinetic energy of the bullet B, and a second housing 210 configured to house a propelling means that is disposed in front of the first housing 220, is activated by the kinetic energy of the bullet B absorbed into the trapping means, and provides a propelling force in a trajectory direction of the rifle grenade, and a stabilizer assembly 300 in which a hollow 310 through which the bullet B can go is formed, which is coupled to the propellent assembly 200 in the front of the hollow 310 so as to face the first housing 220, and which is coupled to the gun in the rear of the hollow 310 so that the bullet B can reach the propellent assembly 200 through the hollow 310.

Here, the rifle grenade further includes a protective shell 100 that is coupled to the front of the propellent assembly 200. The protective shell 100 is provided with a holder 120 which is movably installed in a third housing 110 formed therein, and a damping means which is disposed between the third housing 110 and the holder 120 and reduces an external impact transmitted to the holder 120.

Figure 3:
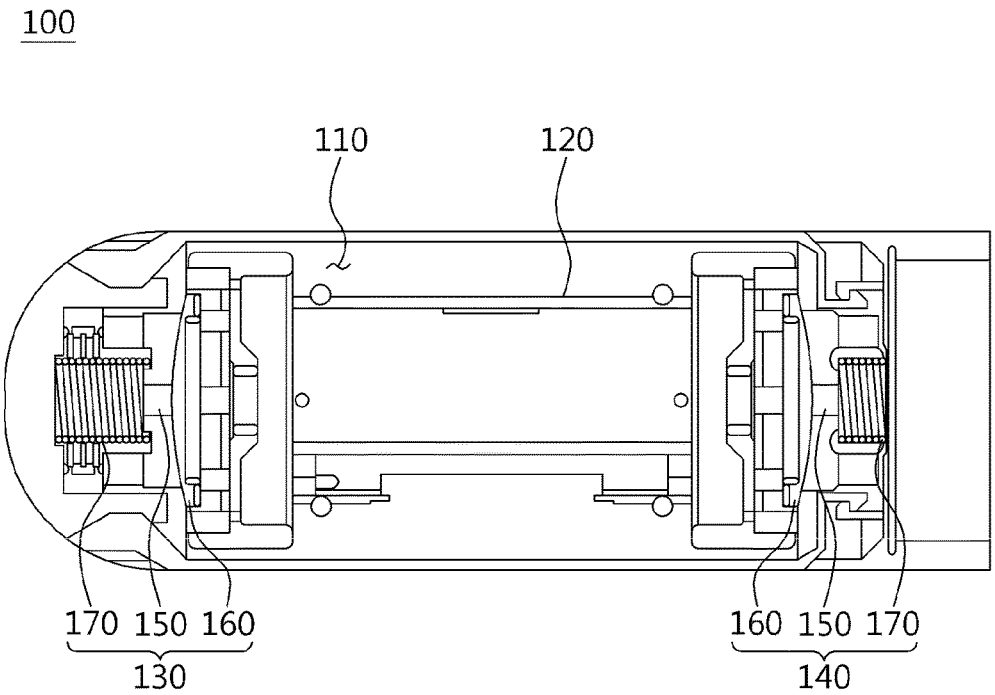
FIG. 3 is a diagram illustrating a protective shell of the rifle grenade.

FIG. 3 is a diagram illustrating a protective shell of the rifle grenade.

The third housing 110 is formed in the protective shell 100. One end of the protective shell 100 which corresponds to the trajectory direction of the long-range rifle grenade according to the present invention is formed in a streamlined shape so as to reduce air resistance.

When the long-range rifle grenade reaches a point of impact, the protective shell 100 is divided into multiple parts by an impact or a signal of a controller, and thus the holder 120 is exposed to the outside.

Like the protective shell 100, the holder 120 is divided into multiple parts by the impact applied to the protective shell 100 or the signal of the controller, and thus the robot 400 mounted in the holder 120 or the warhead is exposed to the outside.

When the long-range rifle grenade reaches the point of impact, the damping means attenuates an impact force through the protective shell 100 so that the robot 400 mounted in the holder 120 or the warhead is not damaged.

The damping means is made up of a first damper 130 supported in the front of the third housing 110, and a second damper 140 supported at the rear of the third housing 110.

Preferably, the first damper 130, which is located in the front of the third housing 110 and is subjected to greatest impact by collision with the point of impact when the protective shell 100 reaches the point of impact, is designed to have a damping force better than that of the second damper 140.

Each of the first damper 130 and the second damper 140 is made up of a cylinder 150 which has a flange 160 whose one end portion is supported on the third housing 110 and whose other end portion is supported on the holder 120 and which is extendable between one end and the other end thereof, and an elastic member 170 which is provided on an outer surface of the cylinder 150, and is installed so as to be supported on the third housing 110 and the flange 160.

In other words, in the moment the long-range rifle grenade is fired, a force applied to the rear of the long-range rifle grenade is exerted on the holder 120 in the protective shell 100 due to inertia. The second damper 140 absorbs an inertial force exerted on the holder 120 while undergoing compressive deformation.

When the long-range rifle grenade reaches the point of impact, the impact is caused by the collision in the front of the protective shell 100, and the force applied to the front of the long-range rifle grenade is exerted on the holder 120. The first damper 130 absorbs the inertial force exerted on the holder 120 while undergoing compressive deformation.

The damping means may further include a damping pad (now shown) which is provided on an inner circumferential surface of the third housing 110 so as to reduce an impact transmitted on an outer circumferential surface of the holder 120.

The damping pad provided on the inner circumferential surface of the third housing 110 prevents an outer surface of the holder 120 from colliding with the inner circumferential surface of the third housing 110.

Figure 6:
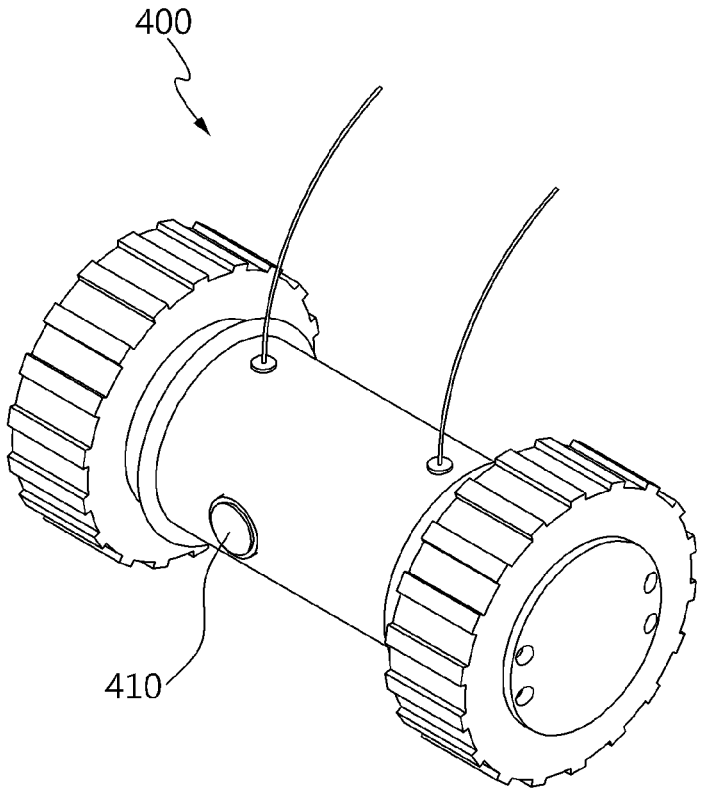
FIG. 6 is a perspective view illustrating a robot capable of being held in the protective shell.
Figure 7:
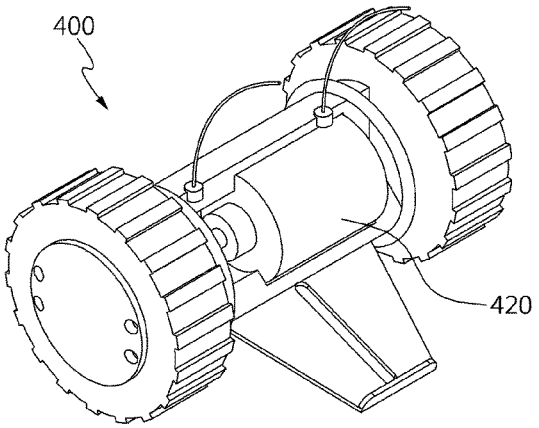
FIG. 7 is a perspective view illustrating an explosive cartridge capable of being mounted in the robot of FIG. 6.

FIG. 6 is a perspective view illustrating a robot 400 capable of being held in the protective shell 100, and FIG. 7 is a perspective view illustrating an explosive cartridge 420 capable of being mounted in the robot of FIG. 6.

The holder 120 may be mounted with the robot 400 which is provided with a wireless communication unit (now shown) transmitting and receiving a control signal and data to and from an external controller (not shown) and which can be remotely controlled.

The robot 400 is provided with a space capable of mounting various small electronic devices or an explosive.

The robot 400 is provided with one or more wheels so as to be able to free to move using the controller.

The robot 400 is provided with a photographing unit 410 which can photograph the point of impact of the long-range rifle grenade, that is, a surrounding environment of a place where the robot 400 is located, and transmit photographed video data to the controller using the wireless communication unit.

In other words, it is possible to monitor internal situations and structure of the place where the robot 400 is located through the controller, and thus it is possible to carry out reconnaissance on behalf of our troops.

The robot 400 may be provided with an explosive cartridge 420 which is detonated by the control signal of the controller.

In detail, when the robot encounters enemy personnel or infiltrates major facilities of the enemy personnel while carrying out reconnaissance using the controller, it is possible to detonate the explosive cartridge 420 and thus to perform pinpoint strike.

On the other hand, when the enemy personnel are detected by a sensing means mounted in the robot 400, the explosive cartridge 420 can be set to be automatically detonated using the controller.

In other words, when the video data cannot be received through the controller or it is difficult to secure a video through the controller, the sensing means of the robot 400 detects the enemy personnel to automatically detonate the explosive cartridge 420.

The sensing means may use various sensors such as an infrared sensor, a thermal sensor, and an ultrasonic sensor.

On the other hand, the holder 120 may be further mounted with a repeater (not shown) configured to increase a wireless communication distance between the controller and the robot 400.

In other words, the repeater is mounted in the holder 120 together with the robot 400. Thereby, an operational radius using the robot 400 can be increased.

Figure 4:
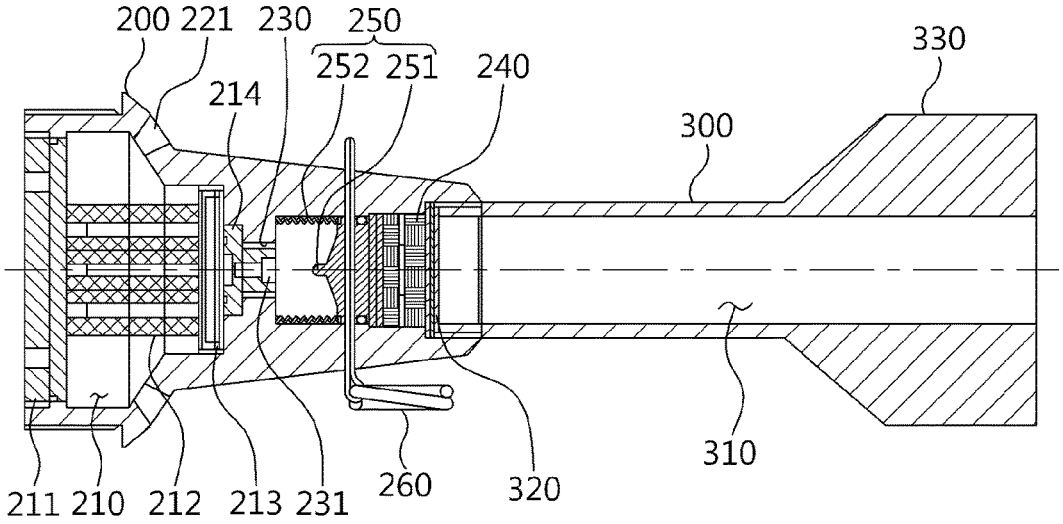
FIG. 4 is a diagram illustrating a propellent assembly and a stabilizer assembly of the rifle grenade.
Figure 5:
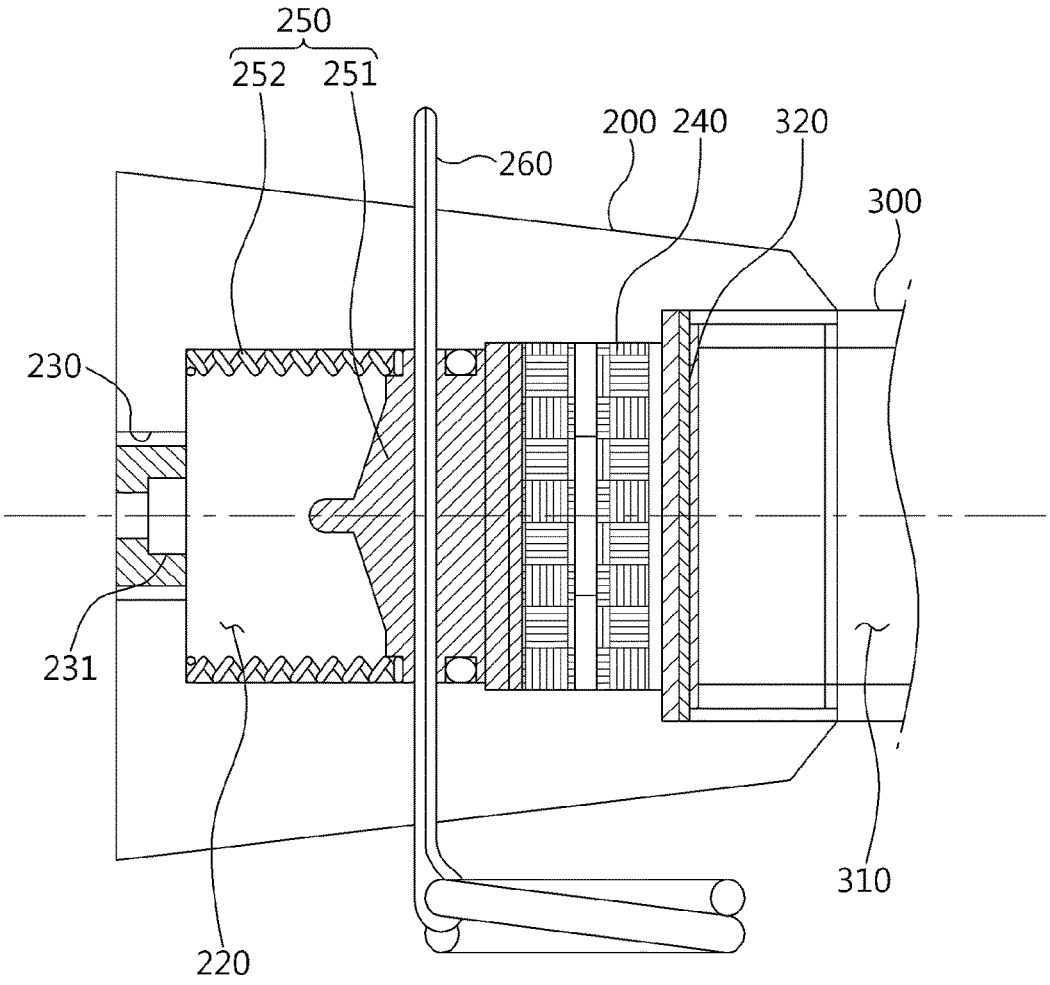
FIG. 5 is a diagram illustrating a percussion part of the rifle grenade.

FIG. 4 is a diagram illustrating a propellent assembly and a stabilizer assembly of the rifle grenade, and FIG. 5 is a diagram illustrating a percussion part of the rifle grenade.

The propellent assembly 200 has a technical feature that a propelling means activated by a bullet B fired from the gun is provided to generate another kinetic energy, separately from the kinetic energy of the bullet B, and increases the effective shooting range of the long-range rifle grenade according to the present invention using a greater propelling force.

Describing the propellent assembly 200 again, the second housing 210 is formed in one end of the propellent assembly 200 which is coupled to the protective shell 100 so as to face the protective shell 100 is formed with a second housing 210, and the propelling means providing the propelling force in a trajectory direction of the protective shell 100 is housed in the second housing 210. The first housing 220 is formed in the other end of the propellent assembly 200 which corresponds to the one end in which the second housing 210 is formed, and the trapping means which traps the bullet B shot from the gun and activates the propelling means using the kinetic energy of the trapped bullet B is housed in the first housing 220.

Description is made under the assumption that a portion at which the propellent assembly 200 is coupled to the protective shell 100 is one end of the propellent assembly 200, and a portion at which the stabilizer assembly 300 is coupled to the propellent assembly 200 is the other end of the propellent assembly 200.

The one end of the propellent assembly 200 is provided with a coupling means that can be firmly coupled with the protective shell 100. It is preferable that the coupling means is also provided for the other end of the propellent assembly 200, and the protective shell 100, the propellent assembly 200, and the stabilizer assembly 300 be designed so as to be separately manufactured and assembled.

All the known coupling means such as a fastening method using threads, a hooking method of hooking a hooking claw on a hooked groove, and a fastening method using bolts and nuts may be applied.

The propellent assembly 200 further includes a plurality of nozzle holes 221 which are formed so as to extend from the outer circumferential surface thereof into the second housing 210.

The nozzle holes 221 are holes in which explosive power, flames, or gases used for the propelling force are spouted when the propelling means is ignited inside the second housing 210. The nozzle holes 221 are preferably formed so as to extend from the inside of the second housing 210 in a rearward direction of the propellent assembly 200 so that the explosive power, the flames, or the gases of the propelling means can be discharged to the rear of the propellent assembly 200 with respect to the trajectory direction of the long-range rifle grenade.

The second housing 210 and the first housing 220 formed in the propellent assembly 200 are connected by a hammer hole 230 which is formed inside the propellent assembly 200 so as to connect central portions of the second housing 210 and the first housing 220.

The trapping means installed in the first housing 220 can activate the propelling means installed in the second housing 210 through the hammer hole 230.

The propelling means includes a propellant 212 housed in the second housing 210, an igniter 213 connected to the propellant 212, and a propellent detonator 231 which is connected to the igniter 213 and installed so as to be inserted into the hammer hole 230.

When the trapping means strikes propellent detonator 231 through the hammer hole 230, the propellent detonator 231 ignites the igniter 213. The flames, the gases, or the explosive power generated while the propellant 212 is burnt by ignition of the igniter 213 are discharged through the nozzle holes 221, and thus the propelling force is provided to the long-range rifle grenade.

In the other hand, the propelling means further includes a retardant 214 which is provided between the propellent detonator 231 and the igniter 213 to retard an ignition time of the igniter 213 for a predetermined time when the propellent detonator 231 is activated.

The bullet B shot from the gun strikes the trapping means within a very short time to activate the propelling means. In this case, surrounding personnel may be injured due to the flames of the propellant 212 when the propellant 212 is burnt with the long-range rifle grenade loaded on the gun. As such, the retardant 214 is provided, so that the long-range rifle grenade is primarily shot by the kinetic energy of the bullet B and thus is discharged from the gun, and then the igniter 213 and the propellant 212 are ignited to secondarily provide an additional propelling force so as to be able to secure safety.

Since the high heat and the explosive power are generated by the igniter 213 and the propellant 212 in the second housing 210 and thus affect the robot 400 or the explosive provided in the holder 120 of the protective shell 100, it is preferable that the second housing 210 further includes a sealing cover 211 which seals the propelling means.

The trapping means traps the bullet B shot from the gun to activate the propelling means using the kinetic energy of the bullet B. The trapping means includes a trap part 240 which is provided at the other end of the first housing 220 facing the stabilizer assembly 300 to trap the bullet B shot so as to pass through the hollow 310, and a percussion part 250 which is provided at the one end of the first housing 220 and activates the propelling means using the kinetic energy of the bullet B trapped by the trap part 240.

The trap part 240 is configured by sequentially stacking a damping plate and a high-strength fiber layer, which can reduce the kinetic energy of the bullet B, and a metal plate that prevents the bullet B from passing through the trap part 240. The trap part 240 may be formed in multiple layers depending on the kinetic energy of the bullet B.

The damping plate primarily reduces initial kinetic energy in which the bullet B intrudes into the trap part 240. Fragments of the bullet B generated when the bullet B passes through the damping plate and then collides with the fiber layer and the metal plate are prevented from being introduced into the gun barrel b of the gun through the hollow 310 of the stabilizer assembly 300 using an elastic rubber material.

The fiber layer is formed in one protective shell by stacking a plurality of layers of aramid-based Kevlar fibers, each of which is a high-strength composite fiber used as a bulletproof material, to a predetermined thickness.

When the bullet B passing through the fiber layer collides with the metal plate, the metal plate converts the kinetic energy of the bullet B into kinetic energy in which the long-range rifle grenade can be shot from the gun. The metal plate functions to prevent the bullet B from passing through the trapping means of the propellent assembly 200 to intrude into the propelling means, thereby protecting the igniter 213 and the propellant 212 of the propelling means.

The percussion part activates the propelling means using the kinetic energy of the bullet B trapped in the trap part 240, and includes a percussion pin 251 which is provided so as to come into close contact with one surface of the trap part 240 which is the opposite surface of the other surface of the trap part 240 which faces the stabilizer assembly 300, and is installed in the first housing 220 so as to be slidable in a direction of the second housing 210, and a safety spring 252 which is installed so as to be supported between the inner surface of the first housing 220 facing the second housing 210 and the percussion pin 251.

With such a configuration, the safety spring 252 elastically supports the percussion pin 251 in a direction in which the stabilizer assembly 300 coupled to the propellent assembly 200 is located at normal times, thereby preventing the percussion pin 251 from striking the propellent detonator 231.

When the stabilizer assembly 300 is coupled to the barrel b of the gun, and the bullet B is fired, the percussion pin 251 overcomes an elastic force of the safety spring 252 due to the kinetic energy generated when the bullet B is trapped by the trap part 240, and pressurizes the safety spring 252. Thereby, the percussion pin 251 strikes the propellent detonator 231 to activate the propelling means.

Preferably, the propellent assembly 200 further includes a safety pin 260 which is installed so as to pass through the percussion pin 251 from the side thereof, thereby preventing the percussion pin 251 from striking the propellent detonator 231 during storage and transportation of the long-range rifle grenade and securing safety.

As described above, the barrel b of the gun is inserted into and mounted in the stabilizer assembly 300. More specifically, the barrel b of the gun is inserted into the hollow 310 of the stabilizer assembly 300.

A safety cover configured to cover the hollow 310 is further provided in the front of the hollow 310 facing the first housing 220.

The safety cover 320 reduces the bullet B shot from the barrel b of the gun, and prevents the fragments of the bullet B generated from the trap part 240 from being introduced into the gun barrel b.

A plurality of fins 330 are provided on an outer circumferential surface of the stabilizer assembly 300 to prompt a stable flight of the long-range rifle grenade.

Figure 8A:
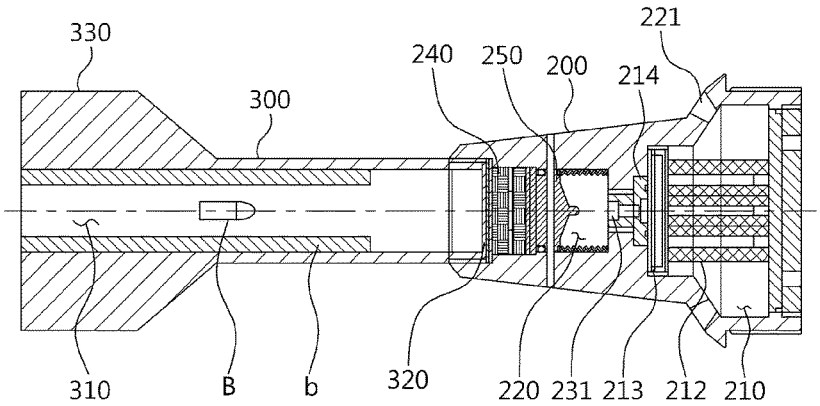
FIGS. 8A to 8E are diagrams illustrating an operation sequence of the propellent assembly using the bullet trap.
Figure 8B:
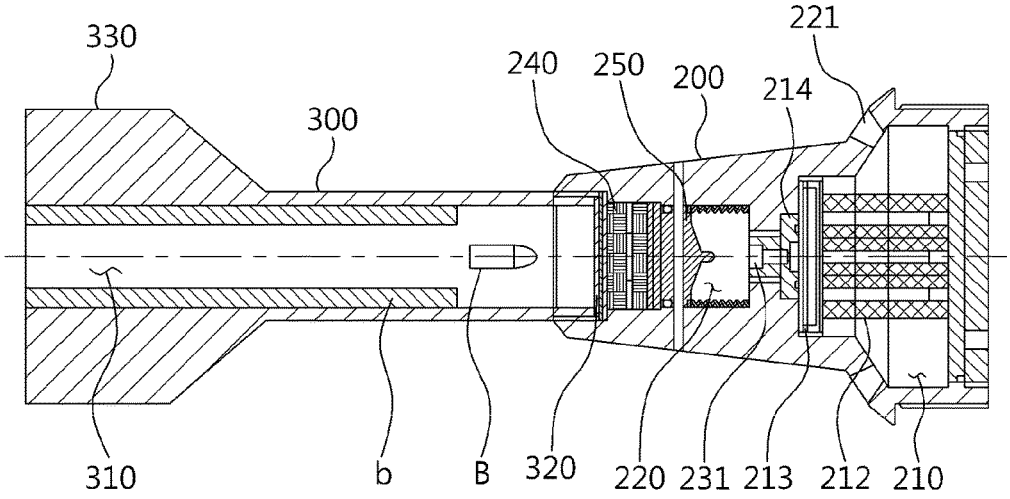

FIGS. 8A to 8E are diagrams illustrating an operation sequence of the propellent assembly using the bullet trap, FIG. 8A is a diagram illustrating a state in which a gun barrel b of a fired bullet B after the long-range rifle grenade is mounted on the gun barrel b, and FIG. 8B is a diagram illustrating a state immediately before the fired bullet B escapes from the gun barrel b and reaches the safety cover 320.

Figure 8C:
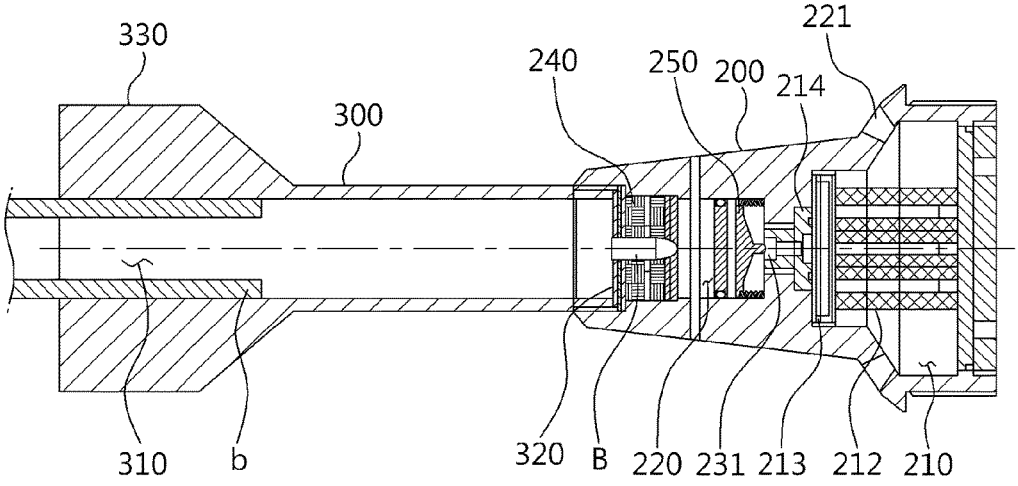

FIG. 8C is a diagram illustrating a state in which the bullet B is trapped by the trap part 240 and the long-range rifle grenade is discharged from the gun barrel b due to kinetic energy of the bullet B. In this state, the percussion pin 251 of the percussion part 250 overcomes elasticity of the safety spring 252 due to the kinetic energy of the bullet B trapped by the trap part 240, and strikes the hammer hole 230, i.e. the propellent detonator 231 in the first housing 220.

Figure 8D:
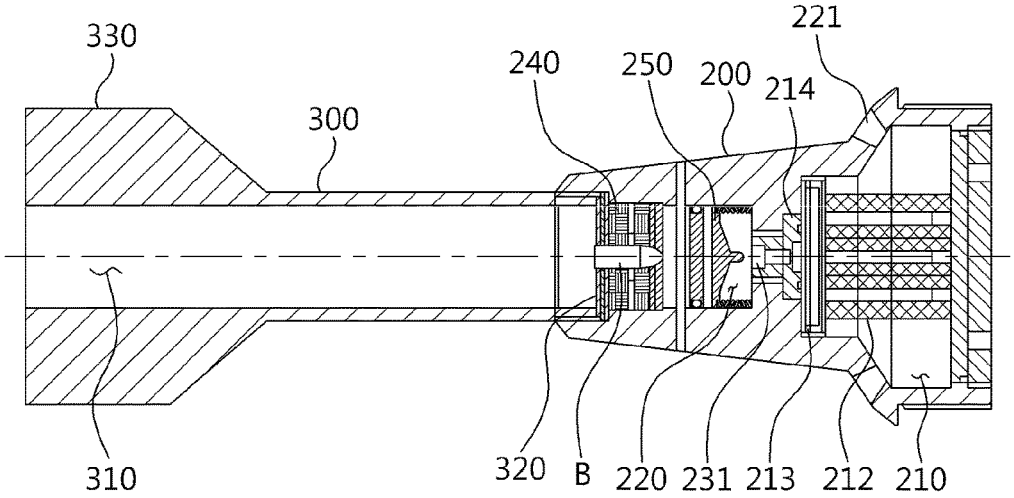

FIG. 8D is a diagram illustrating a process in which, after the long-range rifle grenade is completely discharged from the gun barrel, the percussion pin 251 strikes the propellent detonator 231, and then is returned to its original place by the safety spring 252. In this case, the propellent detonator 231 struck by the percussion pin 251 is activated. The retardant 214 is activated by the propellent detonator 231 and thereby the retardant 214 prevents the igniter 213 from being ignited for a predetermined time.

Here, the predetermined time refers to a time which it can take the long-range rifle grenade to be shot to fly to a safe distance from a user.

Figure 8E:
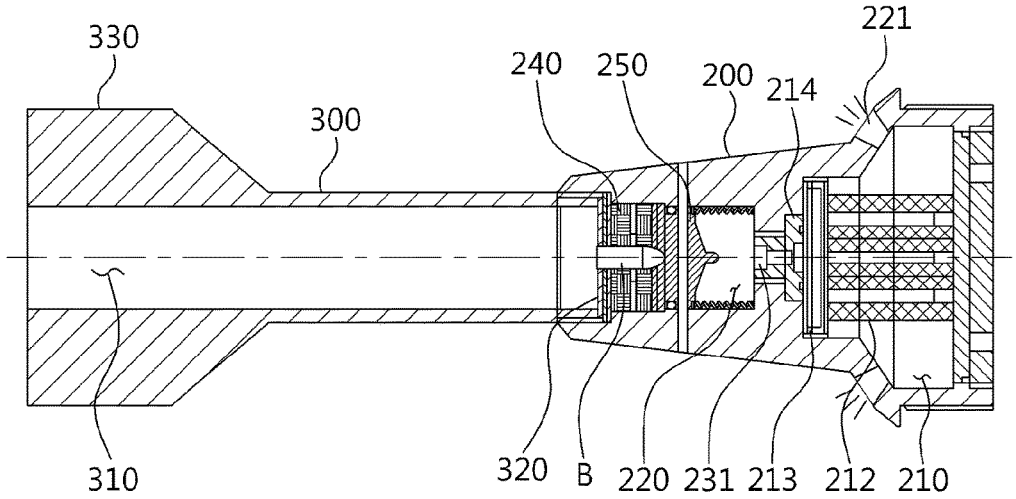

FIG. 8E is a diagram illustrating a state in which the percussion pin 251 is returned to its original place in the first housing 220, and the explosive power, the flames, and the gases generated by the ignition of the propellant 212 are discharged through nozzle holes 221 and provide an additional propelling force to the long-range rifle grenade in addition to the kinetic energy of the bullet B.

As described above, when the long-range rifle grenade according to the present invention is used, the effective shooting range of the rifle grenade mounted on the individual weapon can be increased.

In other words, the propelling means is employed to provide the separate propelling force together with the kinetic energy of the bullet B. Thereby, the effective shooting range and the operational radius of the long-range rifle grenade, which uses the trap of the bullet B according to the present invention and has the warhead in which the robot 400 is mounted, can be increased.

The percussion pin 251 for activating the propelling means is restrained by the safety spring 252 and the safety pin 260, and thereby safety is secured by the safety pin 260 during storage and transport. After the safety pin 260 is removed, the safety spring 252 can stably prevent the percussion pin 251 from striking the propellent detonator 231 until the bullet B is fired.

In addition, the protective shell 100 may be mounted with the robot 400, the explosive, or the repeater which increases the wireless communication distance between the robot 400 and the external controller, and it is possible to reconnoiter the enemy line using the robot 400 or to explode the explosive cartridge 420 mounted on the robot 400 to perform pinpoint strike on the enemy line.

In the above description, the embodiments of the present invention have been disclosed for illustrative purposes with reference to the accompanying drawings. Here, the technical terms and words used in the specification and claims must not be interpreted according to limited definitions thereof, such as ordinary or dictionary meanings, but must be understood to represent meanings and concepts corresponding to the technical scope and spirit of the invention. Thus, those skilled in the art will appreciate that the construction of the embodiments and drawings of the invention has been disclosed as that of preferred embodiments, and thus various modifications, additions and substitutions are possible, without departing from the scope and spirit of the invention as disclosed in the accompanying claims.

What is claimed is:

1. A rifle grenade using a bullet trap, comprising:
- a propellant assembly comprising:
  - a first housing configured to house a trapping means that traps a bullet shot from a gun to travel from rear to front and absorbs kinetic energy of the bullet and
  - a second housing configured to house a propelling means, the propelling means disposed in front of the first housing, being activated by the kinetic energy of the bullet which is absorbed into the trapping means, and providing a propelling force in a trajectory direction of the rifle grenade;
- a stabilizer assembly in which a holly through which the bullet goes is formed, which is coupled to the propelling means in the front of the hollow so as to face the first housing, and which is coupled to the gun in the rear of the hollow so that the bullet reaches the propelling means through the hollow; and
- a protective shell coupled to the front of the propellant assembly and comprising:
  - a holder which is movably installed in a third housing formed therein; and
  - a damping means which is disposed between the third housing and the holder to reduce an external impact transmitted to the holder.

2. The rifle grenade as set forth in claim 1, wherein the holder is mounted with a robot.

3. The rifle grenade as set forth in claim 1, wherein the damping means includes:
- a first damper supported in the front of the third housing; and
- a second damper supported at the rear of the third housing.

4. The rifle grenade as set forth in claim 3, wherein each of the first damper and the second damper includes:
- a cylinder which has a flange whose one end is supported on the third housing and whose other end is supported on the holder, and is extendable between one end and the other end thereof; and
- an elastic member which is provided on an outer surface of the cylinder, and is installed so as to be supported at the third housing and the flange.

5. The rifle grenade as set forth in claim 3, wherein the damping means further includes a damping pad which is provided on an inner circumferential surface of the third housing and reduces an impact transmitted to an outer circumferential surface of the holder.

6. A rifle grenade using a bullet trap, comprising:
- a propellant assembly comprising:
  - a first housing configured to house a trapping means that traps a bullet shot from a gun to travel from rear to front and absorbs kinetic energy of the bullet;
  - a second housing configured to house a propelling means, the propelling means disposed in front of the first housing, being activated by the kinetic energy of the bullet which is absorbed into the trapping means, and providing a propelling force in a trajectory direction of the rifle grenade; and
  - a plurality of nozzle holes which are formed so as to extend from the outer circumferential surface of the propellant assembly into the second housing; and
- a stabilizer assembly in which a hollow through which the bullet goes is formed, which is coupled to the propelling means in the front of the hollow so as to face the first housing, and which is coupled to the gun in the rear of the hollow so that the bullet reaches the propelling means through the hollow.

7. The rifle grenade as set forth in claim 1, wherein the propellant assembly further includes a hammer hole which is formed so as to extend from the second housing to the first housing.

8. A rifle grenade using a bullet trap, comprising:
- a propellant assembly comprising:
  - a first housing configured to house a trapping means that traps a bullet shot from a gun to travel from rear to front and absorbs kinetic energy of the bullet and
  - a second housing configured to house a propelling means, the propelling means disposed in front of the first housing, being activated by the kinetic energy of the bullet which is absorbed into the trapping means, and providing a propelling force in a trajectory direction of the rifle grenade;
- a stabilizer assembly in which a hollow through which the bullet goes is formed, which is coupled to the propelling means in the front of the hollow so as to face the first housing, and which is coupled to the gun in the rear of the hollow so that the bullet reaches the propelling means through the hollow, wherein the propelling means includes:
- a propellant housed in the second housing;
- an igniter connected to the propellant; and
- a propellant detonator which is connected to the igniter and installed so as to be inserted into the hammer hole.

9. The rifle grenade as set forth in claim 8, wherein the propelling means further includes a retardant which is provided between the propellant detonator and the igniter to retard an ignition time of the igniter for a predetermined time when the propellant detonator is activated.

10. The rifle grenade as set forth in claim 1, wherein the propellant assembly further includes a sealing cover which is provided in the second housing so as to seal the propelling means.

11. The rifle grenade as set forth in claim 1, wherein the trapping means includes:
- a trap part which is provided at a rear inner side of the first housing facing the hollow and traps the bullet shot so as to go through the hollow; and
- a percussion part which is provided at a front inner side of the first housing and activates the propelling means using the kinetic energy of the bullet trapped by the trap part.

12. The rifle grenade as set forth in claim 11, wherein the percussion part includes:

a percussion pin which is provide so as to come into close contact with one surface of the trap part which is the opposite surface of the other surface of the trap part which faces the stabilizer assembly, and is installed in the first housing so as to be slidable in a direction of the second housing; and a safety spring which is provided at the front inner side of the first housing facing the second housing and is installed so as to elastically support the percussion pin in a rearward direction.

13. The rifle grenade as set forth in claim 12, wherein the kinetic energy of the bullet trapped by the trap part is high enough for the percussion pin to pressurize the safety spring to activate the propelling means.

14. The rifle grenade as set forth in claim 12, wherein the propellant assembly further includes a safety pin which is installed so as to pass through the percussion pin from a side of the propellant assembly.

15. The rifle grenade as set forth in claim 1, wherein the stabilizer assembly further includes a safety cover which is provided in the front of the hollow to cover the front of the hollow.

16. The rifle grenade as set forth in claim 1, wherein the stabilizer assembly further includes a plurality of fins formed on an outer circumferential surface of the stabilizer assembly.

17. The rifle grenade as set forth in claim 2, wherein the robot includes a wireless communication unit configured to transmit and receive a control signal and data to and from an external controller, and is remotely controlled.

18. The rifle grenade as set forth in claim 17, wherein the robot includes a photographing unit which is installed on the robot to transmit video data obtained by photographing an environment around a place where the robot is located to the controller using the wireless communication unit.

19. The rifle grenade as set forth in claim 17, wherein the robot includes an explosive cartridge which is installed in the robot to be exploded by the control signal of the controller.

20. The rifle grenade as set forth in claim 19, wherein the explosive cartridge includes a fragmentation or thermobaric warhead to which a high explosive for causing casualties is applied.

21. The rifle grenade as set forth in claim 19, wherein the explosive cartridge includes a warhead to which a tear gas or a sleeping gas that is a non-lethal weapon is applied.

22. The rifle grenade as set forth in claim 19, wherein, when enemy personnel are detected by a sensing means embedded in the robot, the robot is set so as to allow the explosive cartridge to be automatically exploded using the controller.

23. The rifle grenade as set forth in claim 19, wherein the holder further includes a repeater configured to increase a wireless communication distance between the controller and the robot.

* * * * *